US008469019B2

(12) United States Patent
Barritt et al.

(10) Patent No.: US 8,469,019 B2
(45) Date of Patent: Jun. 25, 2013

(54) METHOD AND APPARATUS FOR PROVIDING ULTRA LOW GAS BURNER PERFORMANCE FOR A COOKING APPLIANCE

(75) Inventors: William D. Barritt, Cleveland, TN (US); Mark A. Pickering, Cleveland, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 711 days.

(21) Appl. No.: 12/627,272

(22) Filed: Nov. 30, 2009

(65) Prior Publication Data

US 2011/0126822 A1 Jun. 2, 2011

(51) Int. Cl.
*F24C 3/02* (2006.01)

(52) U.S. Cl.
USPC ..... 126/39 BA; 126/39 E; 431/89

(58) Field of Classification Search
USPC 126/39 BA, 39 E, 39 R; 431/89; 251/129.04, 251/129.08
See application file for complete search history.

(56) References Cited

U.S. PATENT DOCUMENTS

| | | | | |
|---|---|---|---|---|
| 5,429,111 | A * | 7/1995 | Akamatsu | 126/52 |
| 5,924,857 | A | 7/1999 | Frasnetti et al. | |
| 5,938,425 | A | 8/1999 | Damrath et al. | |
| 6,247,919 | B1 | 6/2001 | Welz, Jr. et al. | |
| 6,287,108 | B1 | 9/2001 | Rothenberger et al. | |
| 6,332,408 | B2 | 12/2001 | Howlett et al. | |
| 6,619,613 | B1 | 9/2003 | Akamatsu et al. | |
| 7,255,100 | B2 | 8/2007 | Repper et al. | |
| 2004/0004559 | A1 | 1/2004 | Rast | |
| 2005/0221243 | A1 | 10/2005 | Najewicz et al. | |
| 2008/0124668 | A1 | 5/2008 | Schultz et al. | |

* cited by examiner

*Primary Examiner* — Alfred Basichas

(57) ABSTRACT

A cooking appliance a gas burner configured to generate a quantity of heat is disclosed. The cooking appliance also includes a pressure sensor operable to measure the pressure of gas supplied to the gas burner from a gas control valve. The gas control valve is operable to adjust the supply of gas to the gas burner based on the measured pressure of the gas.

12 Claims, 9 Drawing Sheets

METHOD AND APPARATUS FOR PROVIDING ULTRA LOW GAS BURNER PERFORMANCE FOR A COOKING APPLIANCE

TECHNICAL FIELD

The present disclosure relates generally to a gas cooking range having gas burners and more particularly to gas cooking ranges with gas burner control devices.

BACKGROUND

A gas cooking range is used to cook meals and other foodstuffs on a cooking surface or within an oven. The range uses natural gas or liquid petroleum (i.e., propane) fuel to create a controlled flame that generates the heat necessary for cooking. Ranges typically include various control valves, control knobs, and electronics to regulate the supply of gas.

SUMMARY

According to one aspect, a cooking appliance is disclosed. The cooking appliance includes a cooktop having a cooking surface, a gas burner positioned below the cooking surface that is configured to generate a quantity of heat at the cooking surface, and an electronically-controlled gas valve fluidly coupled to the gas burner to control a supply of gas thereto. The cooking appliance also includes a pressure sensor operable to measure the pressure of the gas supplied to the gas burner from the gas valve and generate an electrical output signal indicative thereof and an electronic controller electrically coupled to both the gas burner and the pressure sensor. The controller includes a processor and a memory device electrically coupled to the processor. The memory device has stored therein a plurality of instructions which, when executed by the processor, cause the processor to communicate with the pressure sensor to determine the measured pressure of the gas supplied to the gas burner, compare the measured pressure with a target pressure, and operate the gas valve to adjust the supply of gas to the gas burner based on the difference between the measured pressure and the target pressure.

In some embodiments, the cooking appliance may include an oven positioned below the cooktop that has a cooking chamber, and an oven gas burner operable to heat the cooking chamber. The gas valve may be fluidly coupled to the oven gas burner. In some embodiments, the cooking appliance may include a flame sensor electrically coupled to the electronic controller. The flame sensor may be operable to detect presence of a flame in the gas burner and generate an electrical output signal indicative thereof. The plurality of instructions when executed by the processor may cause the processor to communicate with the flame sensor to determine if the flame has been detected within a predefined time interval, and operate the gas valve to shut off the supply of gas to the gas burner when no flame has been detected within the predefined time interval.

In some embodiments, the gas valve may be operable to supply gas to the gas burner at a periodic rate. In some embodiments, the cooking appliance may include a control switch electrically coupled to the electronic controller. The control switch may be operable to generate an electrical output signal indicative of a user-desired quantity of heat. The plurality of instructions when executed by the processor may cause the processor to receive the electrical output signal and select the target pressure and a predefined periodic rate of gas delivery that corresponds to the user-desired quantity of heat and operate the gas valve to supply gas at the target pressure in accordance with the predefined periodic rate. Additionally, in some embodiments, the plurality of instructions when executed by the processor may cause the processor to receive the electrical output signal and select the target pressure that corresponds to the control switch position.

In some embodiments, the memory device may have stored therein a plurality of pressure values as a function of a plurality of control switch positions. The plurality of instructions when executed by the processor may cause the processor to select one of the plurality of pressure values as the target pressure when the control switch is in one of the plurality of control switch positions.

Additionally, in some embodiments, the memory device may have stored therein the plurality of pressure values and the plurality of control switch positions as a look-up table associated with a burner rating of the gas burner. The plurality of look-up tables may be associated with a plurality of burner ratings. The plurality of instructions when executed by the processor may cause the processor to select the burner rating and the look-up table associated therewith when the control switch is in one of the plurality of control switch positions.

According to another aspect, a method of operating a cooking appliance is disclosed. The method includes receiving a user-input signal corresponding to a desired quantity of heat to be delivered by a gas burner to a cooking surface, determining a burner rating of the gas burner, setting a target pressure at which to supply gas to the gas burner based on the user-input signal and the burner rating, and operating a gas control system to supply gas to the gas burner at the target pressure. In some embodiments, determining the burner rating may include generating a control signal to activate a calibration procedure, supplying gas to a gas control valve at a predetermined calibration pressure in response to generation of the control signal, opening the gas control valve to a calibration valve position in response to generation of the control signal, measuring the pressure of the gas supplied to the gas burner, calculating a burner orifice diameter based on the predetermined calibration pressure, calibration valve position, and measured pressure of the gas supplied to the gas burner, and determining the burner rating based on the burner orifice diameter.

Additionally, in some embodiments, the method may include measuring the pressure of the gas supplied to the gas burner, comparing the measured pressure of the gas to the target pressure, and determining a gas type based on the difference between the measured pressure and the target pressure. In some embodiments, the method may include modifying the target pressure when the measured pressure is outside of a predefined range.

In some embodiments, setting the target pressure may include selecting a look-up table based on the burner rating. The look-up table may have stored therein a plurality of pressure values as a function of a plurality of user-input signals. The method may also include selecting a pressure value from the look-up table that corresponds to the user-input signal, and setting the selected pressure value as the target pressure.

In some embodiments, operating a gas control system may include supplying gas to the gas burner, igniting the gas in the gas burner to produce a controlled flame, measuring the pressure of the gas supplied to the gas burner, comparing the measured pressure with a target pressure, and adjusting the supply of gas based on the difference between the measured pressure and the target pressure. Additionally, in some embodiments, the method may include supplying gas to the gas burner at the target pressure in accordance with a predefined periodic rate.

In some embodiments, the method may include sensing presence of a flame in the gas burner. Additionally, in some embodiments, the method may include shutting off the supply of gas to the gas burner when the presence of the flame is not sensed after a predefined time interval.

According to another aspect, the method includes receiving a user-input signal corresponding to a desired temperature in an oven, determining a burner rating of a gas burner operable to heat the oven, setting a target pressure at which to supply gas to the gas burner based on the user-input signal and the burner rating, supplying gas to the gas burner, igniting the gas in the gas burner to produce a controlled flame, measuring the pressure of the gas supplied to the gas burner, comparing the measured pressure of the gas to the target pressure, and adjusting the supply of gas based on the difference between the measured pressure and the target pressure such that the desired temperature is produced in the oven.

BRIEF DESCRIPTION OF THE DRAWINGS

The detailed description particularly refers to the following figures, in which.

DETAILED DESCRIPTION OF DRAWINGS

Figure 1:
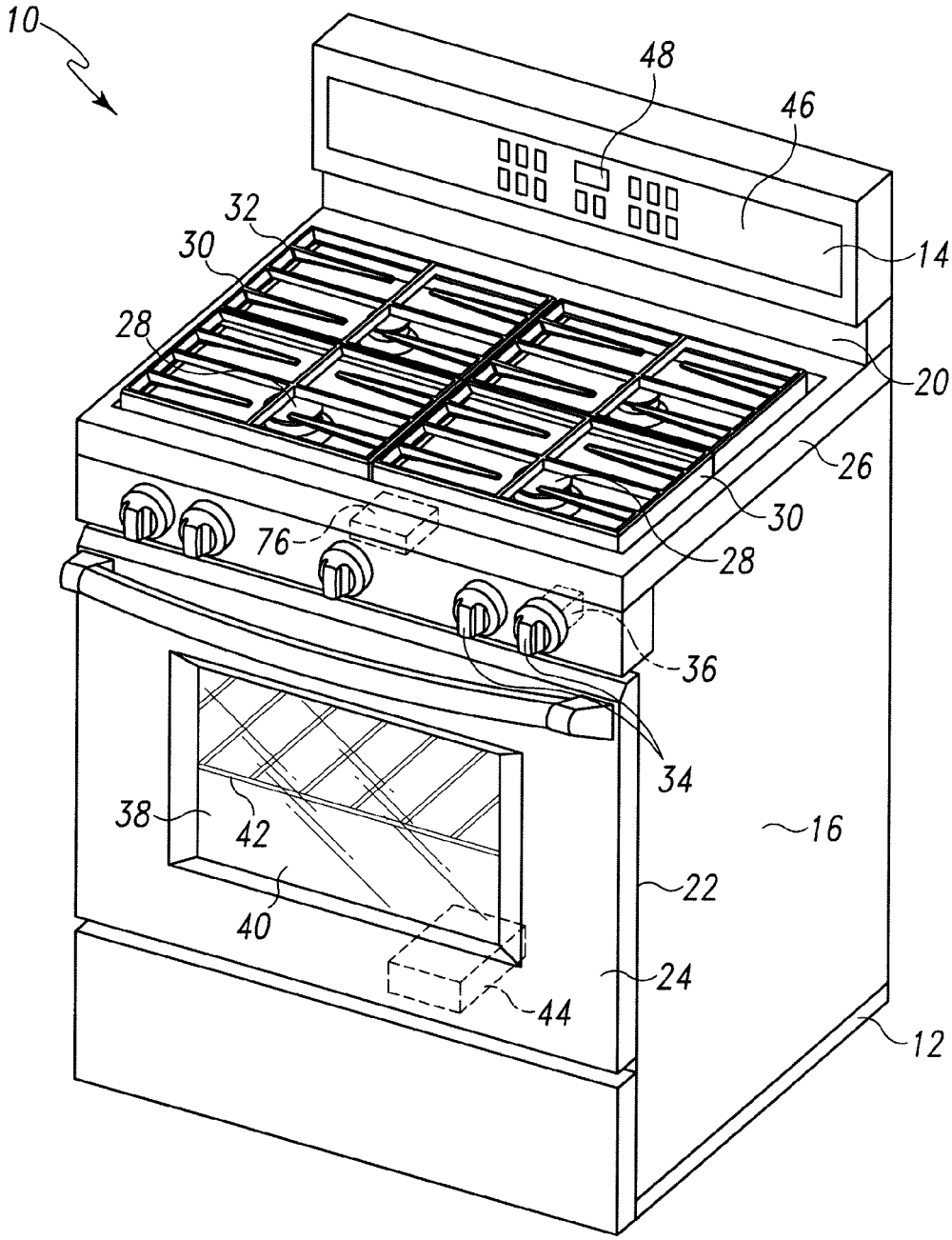
FIG. 1 is a perspective view of a gas cooking range.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a gas cooking range assembly 10 (hereinafter range 10) includes a lower frame 12 and an upper panel 14. A housing 16 extends upwardly from the lower frame 12. The upper panel 14 has a laterally extending base 20 that is secured to the housing 16. An oven 22 is accessible from the front of the housing 16. The oven 22 has a cooking chamber (not shown) into which pans, sheets, or other cookware carrying food items are placed to be heated. A door assembly 24 is hinged to the front of the housing 16 and permits access to the cooking chamber. The oven 22 has a baking element (not shown) that is configured to provide heat for baking or otherwise cooking food items placed in the cooking chamber.

A cooktop 26 is positioned above the oven 22 and below the upper panel 14. The cooktop 26 includes a number of gas burners 28. Each of the burners 28 has a grate 30 positioned above it, and the grates 30 define a cooking surface 32. Each of the burners 28 is configured to produce a controlled flame that generates a quantity of heat, which may be used to heat cooking utensils (i.e., pots and pans) placed on the grates 30. The burners 28 and grates 30 are arranged on the cooktop 26 such that a user can simultaneously heat pots, pans, skillets, and the like.

The magnitude of the heat generated by each of the burners 28 is proportionate to the amount of gas supplied to the burner 28. A user may adjust the supply of gas to the burners 28 using a set of knobs 34 that are positioned at the front of the housing 16. Each knob 34 is coupled to a control switch 36 operable to generate an electrical output signal that is relayed to a control system 50 (see FIG. 2). As the user rotates each of the knobs 34, the electrical output signal changes and the control system 50 responds by adjusting the amount of gas flowing to the corresponding burner 28, as described in greater detail below.

An oven 38 is accessible from the front of the housing 18. The oven 38 has a cooking chamber 40 into which pans, sheets, or other cookware carrying food may be placed to be heated. The cooking chamber 40 includes a number of racks 42 located therein. A door assembly (not shown) is hinged to the front of the housing 18 and permits access to the cooking chamber 40. A gas-fired bake burner 44 with its associated cover is located below the rack 42. The bake burner 44 is configured to provide heat for baking or otherwise cooking food items in the cooking chamber 40.

A user may control the operation of the oven 38 using a control interface 46 located on the upper panel 14. The control interface 46 includes a set of push buttons 48 that are connected to an automated control system, such as, for example, control system 50, operable to control the operation of the oven 38. For example, the user may use the control interface 46 to set a desired temperature for each oven. The control interface 46 is coupled to a processor (not shown) operable to generate an electrical output signal that is relayed to the control system. The control system responds by igniting a flame with the bake burner 44 and adjusting the supply of gas to the bake burner 44 as necessary to heat the oven 38 to the desired temperature.

Figure 2:
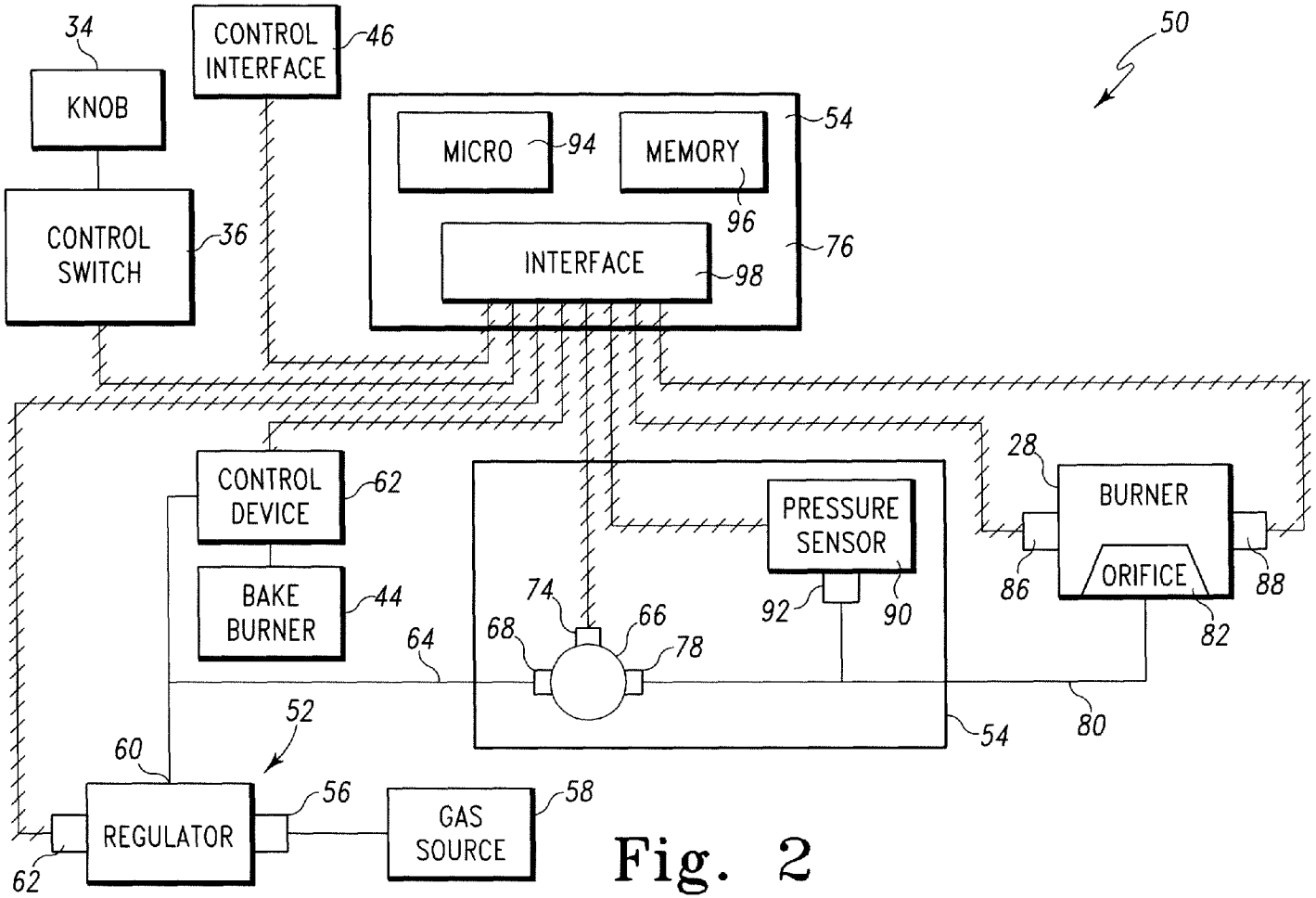
FIG. 2 is a block diagram of a control system for a gas burner of the gas cooking range of FIG. 1.

The control system 50 is represented in block diagram form in FIG. 2 and is operable to control the supply of gas to one of the burners 28 and the bake burner 44 of the oven 36. As shown in FIG. 2, the control system 50 includes a gas pressure regulator 52 electronically operated to regulate the pressure of the gas delivered to a burner control device 54, which is fluidly coupled to one of the gas burners 28. The regulator 52 includes a gas inlet port 56 coupled to a source of gas 58 such as a residential gas wall outlet. Gas is delivered into a gas line 64 coupled to an outlet port 60 of the pressure regulator 52 and advanced to the burner control device 54. Gas is similarly delivered to a burner control device 62, which is coupled to the bake burner 44.

It will be appreciated that in other embodiments the control system 50 may not utilize a gas pressure regulator and instead operates at the pressure of the source of gas. Alternatively, the gas pressure regulator 52 or similar device may only be inserted between the gas line 64 and the source of gas during maintenance and calibration.

The burner control device 54 includes an electronically controlled gas valve 66 operable to control the supply of gas to the gas burner 28. The gas line 64 is coupled to the gas valve 66 at an inlet port 68. The gas valve 66 includes an actuating device, embodied as a piezoelectric drive 74, that moves a valve member (not shown) between a closed valve position and a plurality of open valve positions. It should be appreciated that the actuating device may utilize alternative drive mechanisms, such as an electric drive motor, which is operable to move the valve member.

When the piezoelectric drive 74 moves the valve member to any of the plurality of open valve positions, the inlet port 68 is fluidly coupled to an outlet port 78, and gas is advanced through the gas valve 66 to a gas line 80 coupled to the outlet port 78. As the valve member is opened further, the amount of gas advanced through the gas valve 66 is increased. As shown in FIG. 2, the burner control device 54 includes only a single gas valve 66 and a single gas line 80 and the burner control device 62 controls the supply of gas to the bake burner 44. It should be appreciated that in other embodiments a single burner control device 54 having multiple gas valves 66 and gas lines 80 may be utilized to control the supply of gas to each of the burners 28 and bake burner 44.

Figure 3:
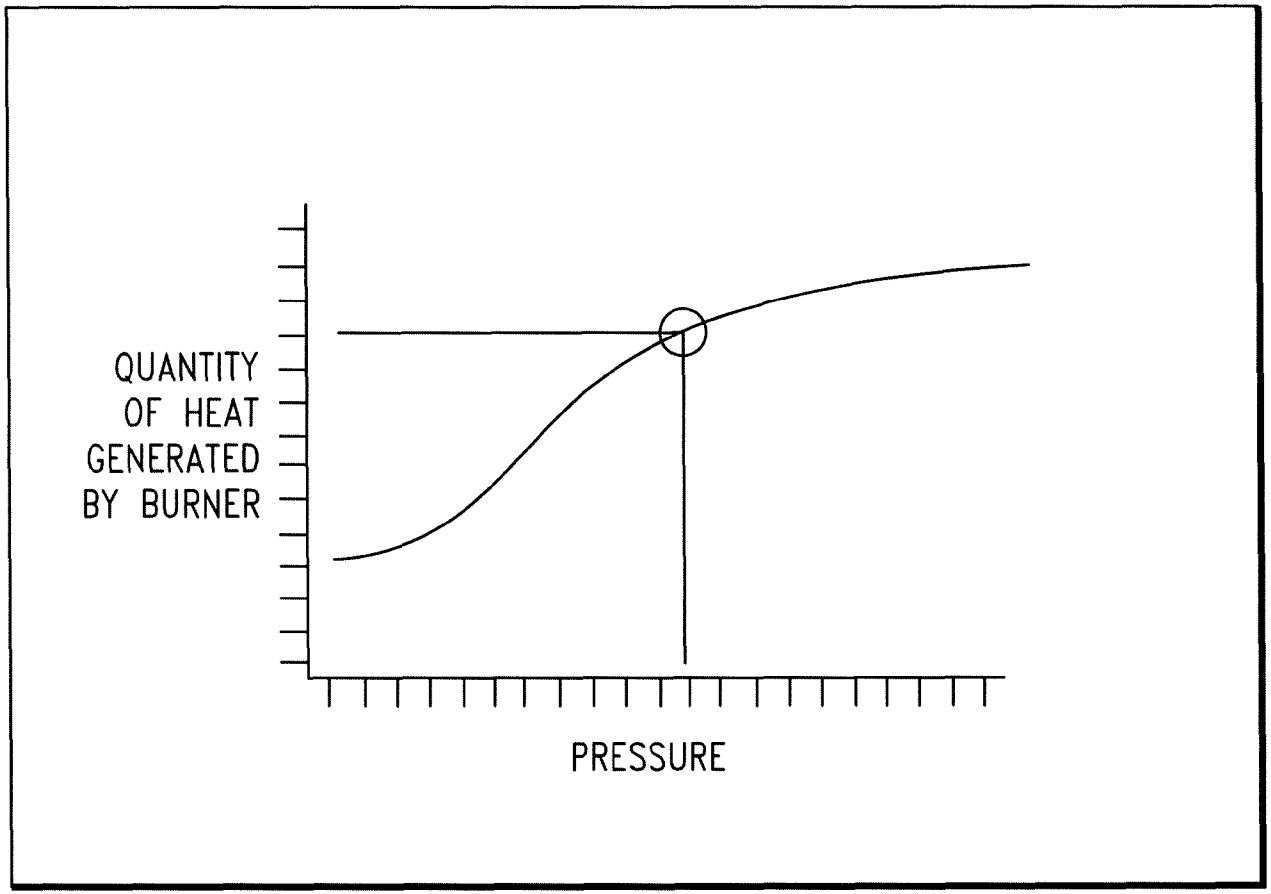
FIG. 3 is a graph illustrating the relationship between the pressure of gas supplied to the gas burner and the heat generated by the gas burner.

Gas advanced through the gas valve 66 is conducted out of the burner control device 54 by the gas line 80. The gas line 80 conducts gas to an orifice 82 of the gas burner 28. The burner 28 includes an ignition device 86 that is operable to ignite gas exiting from orifice 82 and produce a controlled flame in response to control signals received from electronic controller 76. As illustrated in FIG. 3, the quantity of heat generated by the controlled flame is a function of the pressure of the gas supplied to the orifice 82 of the burner 28 via gas line 80. A flame sensor 88 is positioned adjacent to the burner 28 to sense or detect whether a flame is produced in the gas burner 28.

The burner control device 54 also includes a pressure sensor 90 fluidly coupled to the gas line 80 between the outlet port 78 of the gas valve 66 and the orifice 82. As shown in FIG. 2, gas enters the pressure sensor 90 through an inlet port 92. The pressure sensor 90 is operable to take a gauge pressure measurement of the gas supplied to the orifice 82 of the gas burner 28 from the gas valve 66. The term "gauge pressure" as used herein refers to a pressure measurement taken using a scale where zero is referenced against ambient air pressure and corrected to the pressure at sea level. Gauge pressure is therefore distinguishable from, and in contrast to, differential pressure, which is calculated as the difference between pressure measurements taken at two different points in a fluid system. The pressure sensor 90 is operable to generate a control signal indicative of the measured pressure and send that control signal to the electronic controller 76.

The electronic controller 76, as shown in FIGS. 1 and 2, is secured to the range 10 and is, in essence, the master computer responsible for interpreting electrical signals sent by sensors associated with the control system 50 and for activating electronically-controlled components associated with the control system 50. For example, the electronic controller 76 is configured to control operation of the piezoelectric drive 74 and the ignition device 86. The electronic controller 76 is also configured to monitor various signals from the control switch 36, the control interface 46, the flame sensor 88, and the pressure sensor 90. The electronic controller 76 is further configured to determine when various operations of the control system 50 should be performed, amongst many other things. In particular, the electronic controller 76 is operable to control the components of the control system 50 such that the gas burner 28 generates a quantity of heat in response to the user rotating the corresponding knob 34. Similarly, the electronic controller 76 is operable to control the components of the control system 50 such that the bake burner 44 generates a quantity of heat in response to the user accessing the control interface 46.

To do so, the electronic controller 76 includes a number of electronic components commonly associated with electronic units utilized in the control of electromechanical systems. For example, the electronic controller 76 may include, amongst other components customarily included in such devices, a processor such as a microprocessor 94 and a memory device 96 such as a programmable read-only memory device ("PROM") including erasable PROM's (EPROM's or EEPROM's). The memory device 96 is provided to store, amongst other things, instructions in the form of, for example, a software routine (or routines) which, when executed by the microprocessor 94, allows the electronic controller 76 to control operation of the control system 50.

The electronic controller 76 also includes an analog interface circuit 98. The analog interface circuit 98 converts the output signals from various sensors (e.g., the pressure sensor 90) into a signal which is suitable for presentation to an input of the microprocessor 94. In particular, the analog interface circuit 98, by use of an analog-to-digital (A/D) converter (not shown) or the like, converts the analog signals generated by the sensors into a digital signal for use by the microprocessor 94. It should be appreciated that the A/D converter may be embodied as a discrete device or number of devices, or may be integrated into the microprocessor 94. It should also be appreciated that if any one or more of the sensors associated with the control system 50 generate a digital output signal, the analog interface circuit 98 may be bypassed.

Similarly, the analog interface circuit 98 converts signals from the microprocessor 94 into an output signal which is suitable for presentation to the electrically-controlled components associated with the control system 50 (e.g., the piezoelectric drive 74). In particular, the analog interface circuit 98, by use of a digital-to-analog (D/A) converter (not shown) or the like, converts the digital signals generated by the microprocessor 94 into analog signals for use by the electronically-controlled components associated with the control system 50. It should be appreciated that, similar to the A/D converter described above, the D/A converter may be embodied as a discrete device or number of devices, or may be integrated into the microprocessor 94. It should also be appreciated that if any one or more of the electronically-controlled components associated with the control system 50 operate on a digital input signal, the analog interface circuit 98 may be bypassed.

Hence, the electronic controller 76 may be operated to control operation of the piezoelectric drive 74 and therefore the supply of gas to the burner 28. In particular, the electronic controller 76 executes a routine including, amongst other things, a control scheme in which the electronic controller 76 monitors outputs of the sensors associated with the control system 50 to control the inputs to the electronically-controlled components associated therewith. To do so, the electronic controller 76 communicates with the sensors associated with the control system 50 to determine, amongst numerous other things, whether there is a flame present at the burner 28 and whether the pressure measured by the pressure sensor 90 matches a target pressure for the gas supplied to the burner 28. Armed with this data, the electronic controller 76 performs numerous calculations each second, including taking values from preprogrammed look-up tables, in order to execute algorithms to perform such functions as operating of the ignition device 86 to produce a flame in the burner 28, controlling the supply of gas to the orifice 82 of the burner 28 by monitoring the pressure of the gas supplied to the orifice 82, and adjusting the quantity of heat generated by the burner 28.

It will be appreciated that in other embodiments each burner control device 54 may utilize a separate electronic controller. Additionally, in some embodiments, the electronic controller may be a component of the control device 54. Similarly, the control system 50 may include elements other than those shown and described above, such as, by way of example, a second electronic controller such that the piezoelectric drive 74 and the ignition device 86 may be controlled by separate electronic controllers. It should also be appreciated that the location of many components (i.e., in the burner control device 54, etc.) may also be altered.

Figure 4:
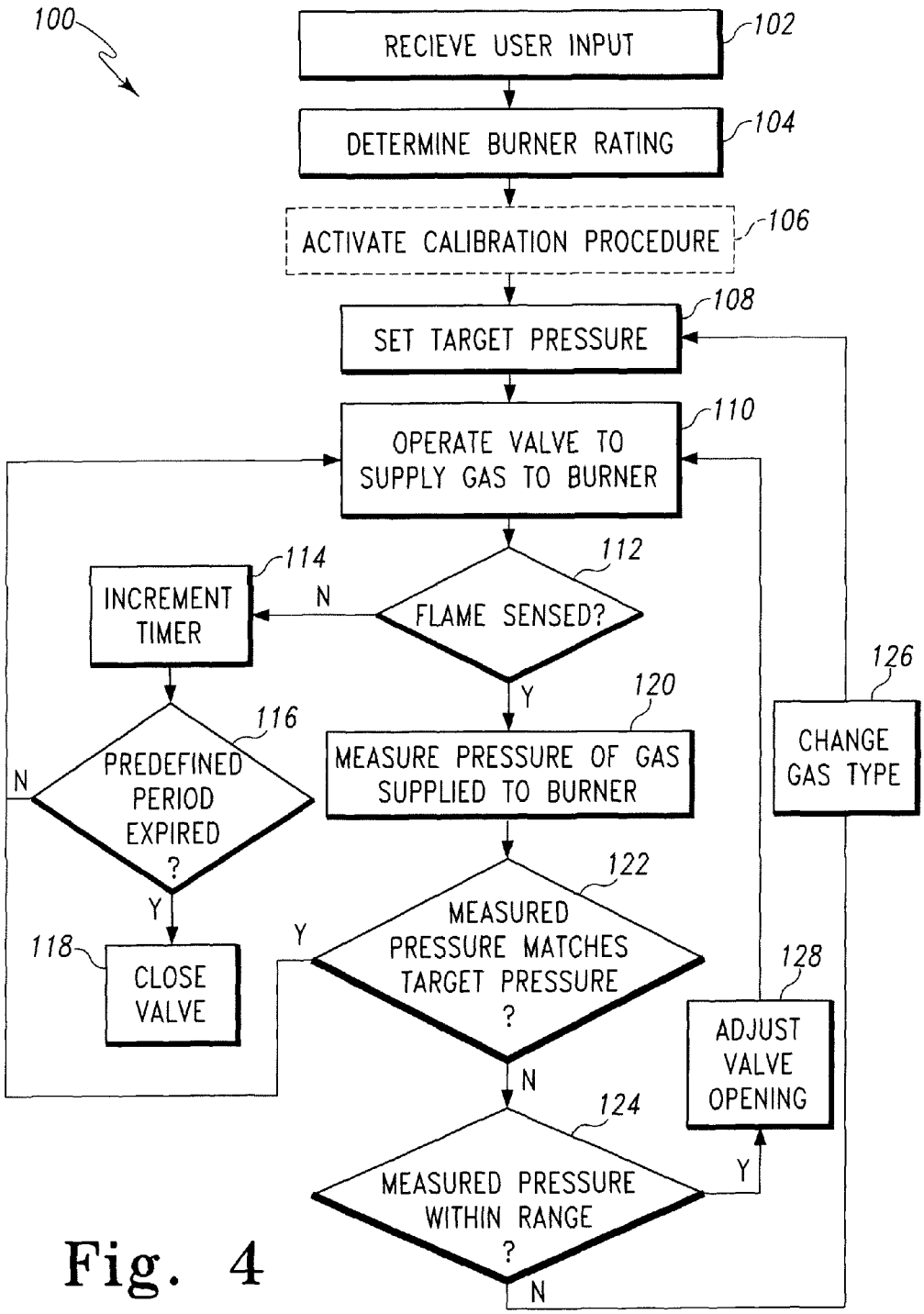
FIG. 4 is a simplified flow diagram for one illustrative control routine of operating the control system of FIG. 2.

Referring to FIG. 4, one illustrative control routine 100 for operating the control system 50 is shown. The routine 100 commences with step 102 in which a user-input signal is received from one of the control switches 36. The control switch 36 generates the user input signal in response to the user rotating one of the knobs 34 to change the user-desired quantity of heat to be generated by the corresponding burner 28. The user input signal therefore corresponds to the user-desired quantity of heat and changes when the user adjusts the position of knob 34.

It should be appreciated that control routine 100 may be implemented with the bake burner 44 of the oven 38. In that case, the user-input signal is generated in response to the user pressing one of the push buttons 48 on the control interface 46. The user-input signal therefore corresponds to both the desired quantity of heat and, consequently, the desired temperature to be produced in the oven 38.

After the user input signal is received, the routine 100 advances to step 104 in which the burner rating associated with the burner 28 is determined. The term "burner rating" as used herein refers to the maximum quantity of heat that may be generated by a given burner. For example, a burner capable of generating 4500 BTUs maximum has a rating of 4500 BTUs. If no burner rating for the burner 28 is stored in the memory device 96, a calibration procedure 200 is used to identify and store the burner rating for the gas burner 28. That procedure is described in greater detail below in regard to FIG. 5. After the burner rating is determined, the routine 100 proceeds to step 108.

In step 108, the electronic controller 76 sets a target pressure at which gas is to be supplied to the orifice 82 of the burner 28 based on the burner rating and the position of the control switch 36. As discussed above, the quantity of heat generated by the burner 28 is a function of the pressure of the gas supplied to the orifice 82. The target pressure is therefore indicative of the desired quantity of heat to be generated by the burner 28.

To set the target pressure, the electronic controller 76 uses the burner rating to select a look-up table associated with that burner rating from the memory device 96. Each look-up table includes a plurality of pressure values stored as a function of a plurality of control switch positions. Using the particular look-up table associated with the burner rating identified for the burner 28, the electronic controller 76 selects the pressure value associated with the current position of the control switch 36 and the user-input signal. The electronic controller 76 sets the selected pressure value as the target pressure.

After setting the target pressure, the routine 100 proceeds to step 110 in which the electronic controller 76 operates the gas valve 66 to supply gas to the burner 28 and operates the ignition device 86 to ignite the gas in the burner 28. Gas may be supplied to the burner 28 continuously or on a periodic basis, depending on the desired quantity of heat and the burner rating of burner 28. When gas is supplied continuously to the burner 28, the gas valve 66 is maintained in one of the open valve positions. When gas is supplied to the burner 28 on a periodic basis, the gas valve 66 is opened and closed on a periodic basis.

In other embodiments, gas may be supplied to the burner 28 in accordance with one of a plurality of predefined periodic rates associated with the target pressure of the gas. In such embodiments, the gas valve 66 is moved between one of the open valve positions and the closed valve position when gas is supplied at the target pressure in accordance with one of the predefined periodic rates. After operating the gas valve 66 to begin supplying gas to the gas burner 28, the routine 100 advances to step 112.

In step 112, the electronic controller 76 communicates with the flame sensor 88 to determine whether a flame has been sensed by the flame sensor 88. If a flame is detected, the routine 100 proceeds to step 120 in which the electronic controller 76 measures the pressure of gas supplied to the gas burner 28. When no flame is detected, the routine 100 advances to step 114 while attempting to ignite the gas burner 28.

In step 114, a timer is incremented while the control system 50 attempts to ignite the flame. Gas continues to be supplied to the gas burner 28 and the electronic controller 76 operates ignition device 86 in an attempt to ignite the gas. In step 116, the electronic controller 76 determines whether a predefined time interval has expired. If a flame has not been detected before the predefined time interval has expired, the routine 100 advances to step 118 in which the gas valve 66 is closed, thereby shutting off the supply of gas to the burner 28.

Returning to step 112, when the presence of a flame is sensed, the routine 100 advances to step 120 in which the electronic controller 76 communicates with the sensor 90 to take a measurement of the pressure of the gas supplied to the burner 28. The sensor 90 generates an output signal indicative of the gas pressure, which is sent to the electronic controller 76. After determining the pressure of the gas, the routine advances to step 122.

In step 122, the electronic controller 76 compares the measured pressure of the gas supplied to the orifice 82 with the target pressure to determine whether the measured pressure matches the target pressure. As used herein in reference to pressure, the terms "match", "matched", and "matches" are intended to mean that the gas pressures are the same as or within a predetermined tolerance range of each other. If the measured pressure matches the target pressure, the gas valve 66 is operated to maintain its current position. When the measured pressure does not match the target pressure, the routine 100 advances to step 124.

In step 124, the electronic controller 76 determines whether the source of gas is natural gas or propane based on the measured pressure. When the measured pressure is outside of a predefined range of pressures associated with natural gas, the electronic controller 76 reconfigures to operate with propane, and the routine advances to step 126. In step 126, the electronic controller 76 loads the operating parameters (target pressures, etc.) associated with propane and resets the target pressure based on the new gas type. When the measured pressure is within the predefined range, the routine 100 advances to step 128.

In step 128, the electronic controller 76 operates the piezoelectric drive 74 to cause the gas valve 66 to increase or decrease the supply of gas to the orifice 82 based on the difference between the target pressure and the measured pressure. In that way, the controller 76 adjusts the supply of gas such that the burner 28 generates the desired quantity of heat. When the routine 100 is utilized to control the supply of gas to the bake burner 44, the controller 76 similarly adjusts the supply of gas such that the bake burner 44 generates the desired quantity of heat and, consequently, produces the desired temperature in the oven. After completing step 128, the routine 100 returns to step 110 to continue operating the burner 28.

Figure 5:
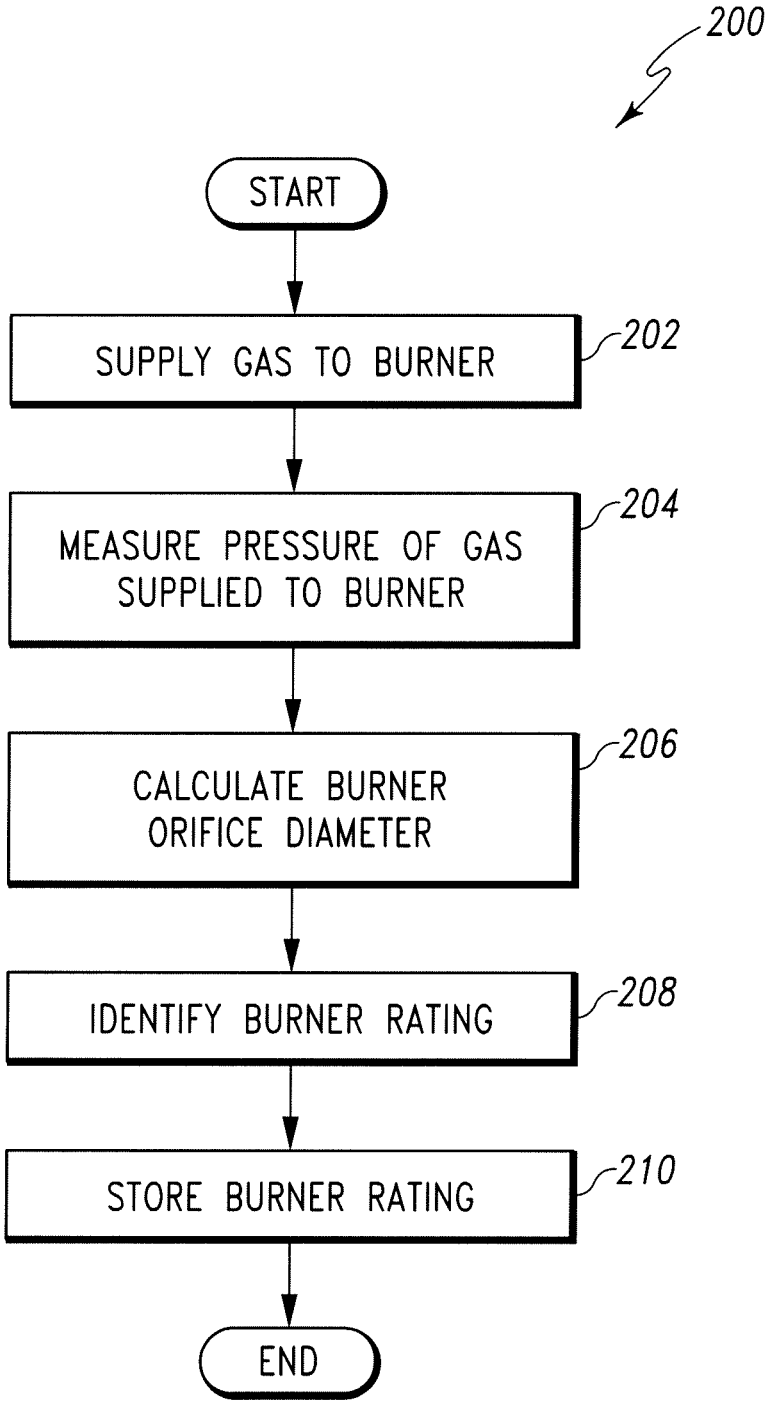
FIG. 5 is a simplified flow diagram of a method for calibrating the control system of FIG. 2.

As discussed above in regard to step 104, the electronic controller 76 may initiate the calibration procedure 200 to identify and store the burner rating for the gas burner 28 when no burner rating is stored in the memory device 96. As shown in FIG. 5, the calibration procedure 200 uses the diameter of the orifice 82 of the gas burner 28 to identify the burner rating. Because the quantity of heat generated by the burner 28 is a function of the pressure of the gas supplied to the orifice 82 of the burner 28, the burner 28 generates the maximum quantity of heat at the maximum operating pressure of the orifice 82, which is determined by the diameter of the orifice 82. As such, the maximum quantity of heat, and, consequently, the burner rating, of the burner 28 is linked to the diameter of the orifice 82. By identifying the diameter of the orifice 82, the burner rating can be determined using a calibration formula that relates orifice diameter to a predetermined calibration pressure, a calibration valve position for the gas valve 66, and the measured pressure of the gas supplied to orifice 82.

The calibration formula may be stored in the memory device 96 prior to installing the burner control device 54 in the range 10. The formula is generated by applying a known pressure (i.e., a predetermined calibration pressure) to the input port 68 of the gas valve 66 when an orifice of known diameter is coupled to the gas line 80. The pressure sensor 90 measures the pressure of the gas supplied to the orifice 82 of the burner 28. The gas valve 66 is opened to a position where the pressure of the gas measured by the pressure sensor 90 matches the maximum pressure associated with that known orifice. That valve position is then stored in the memory device 96 as the calibration valve position. The calibration formula is then generated based on the relationship between the predetermined calibration pressure, the calibration valve position, the measured pressure of the gas supplied to the orifice 82, and the orifice diameter. Because the other variables are known, the calibration formula may be used to calculate the diameter of any orifice 82.

As shown in FIG. 5, the calibration procedure 200 commences with a step 202 in which gas is supplied to the inlet port 68 of the gas valve 66 via the gas pressure regulator 52 at the predetermined calibration pressure. In addition, the electronic controller 76 generates a control signal for the gas valve 66 to move to the calibration valve position. After gas is supplied to the burner 28, the procedure 200 advances to step 204.

In step 204, the pressure sensor 90 takes a pressure measurement of the gas supplied to the orifice 82 and generates an output signal indicative of that pressure. The calibration procedure 200 then advances to step 206 in which the electronic controller 76 utilizes the measured pressure in the calibration formula to calculate the diameter of the orifice 82. Once the diameter of orifice 82 is known, the procedure 200 advances to step 208.

In step 208, the controller 76 selects the burner rating of the burner 28 associated with the orifice diameter. The memory device 96 has stored therein a look-up table of burner ratings stored as a function of orifice diameter. The controller 76 selects the burner rating from the look-up table, and the procedure 200 proceeds to step 210. In step 210, the burner rating is stored in the memory device 96 in step 210 and made available for use in step 108.

Figure 6:
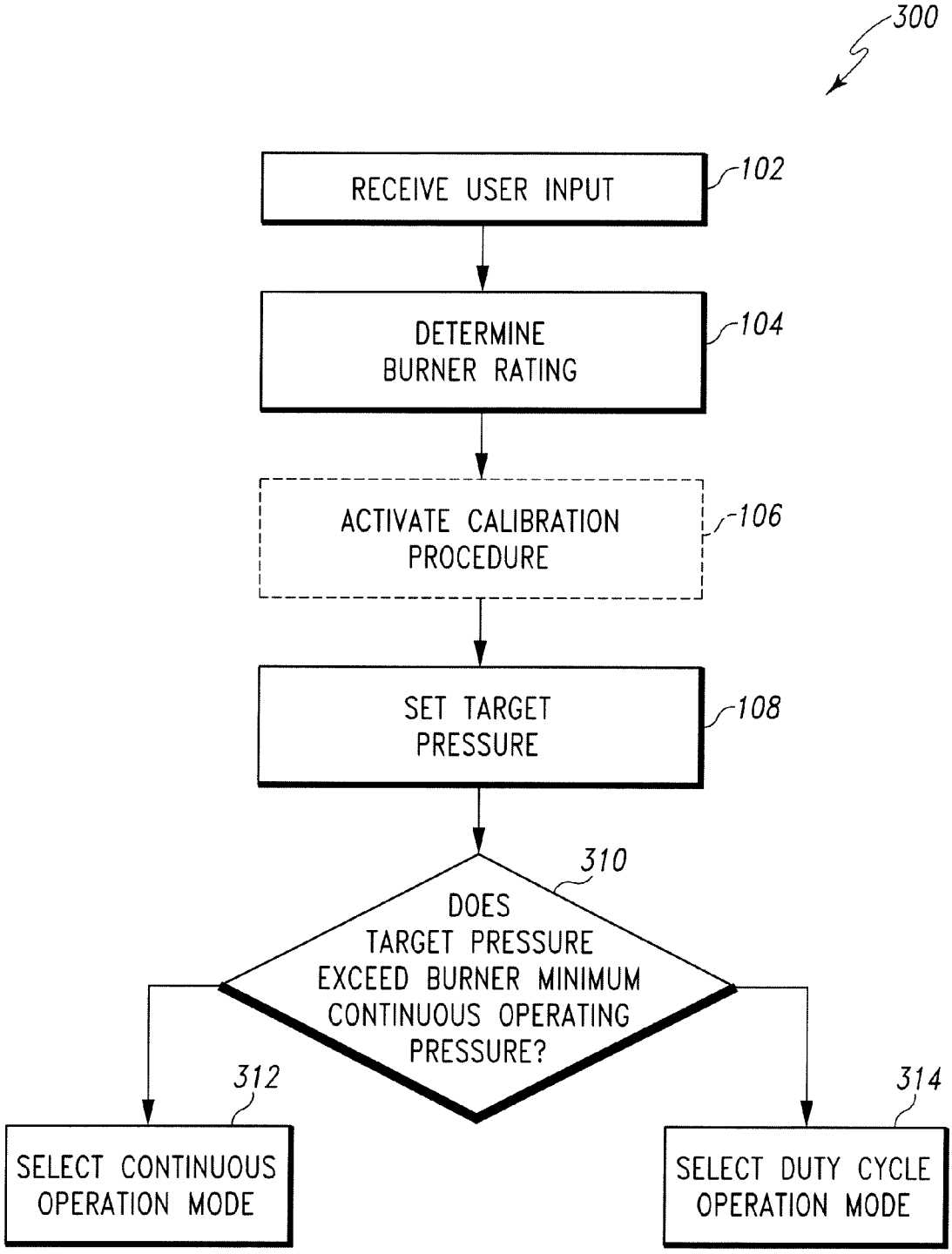
FIG. 6 is a simplified flow diagram for another illustrative control routine of operating the control system of FIG. 2.
Figure 7:
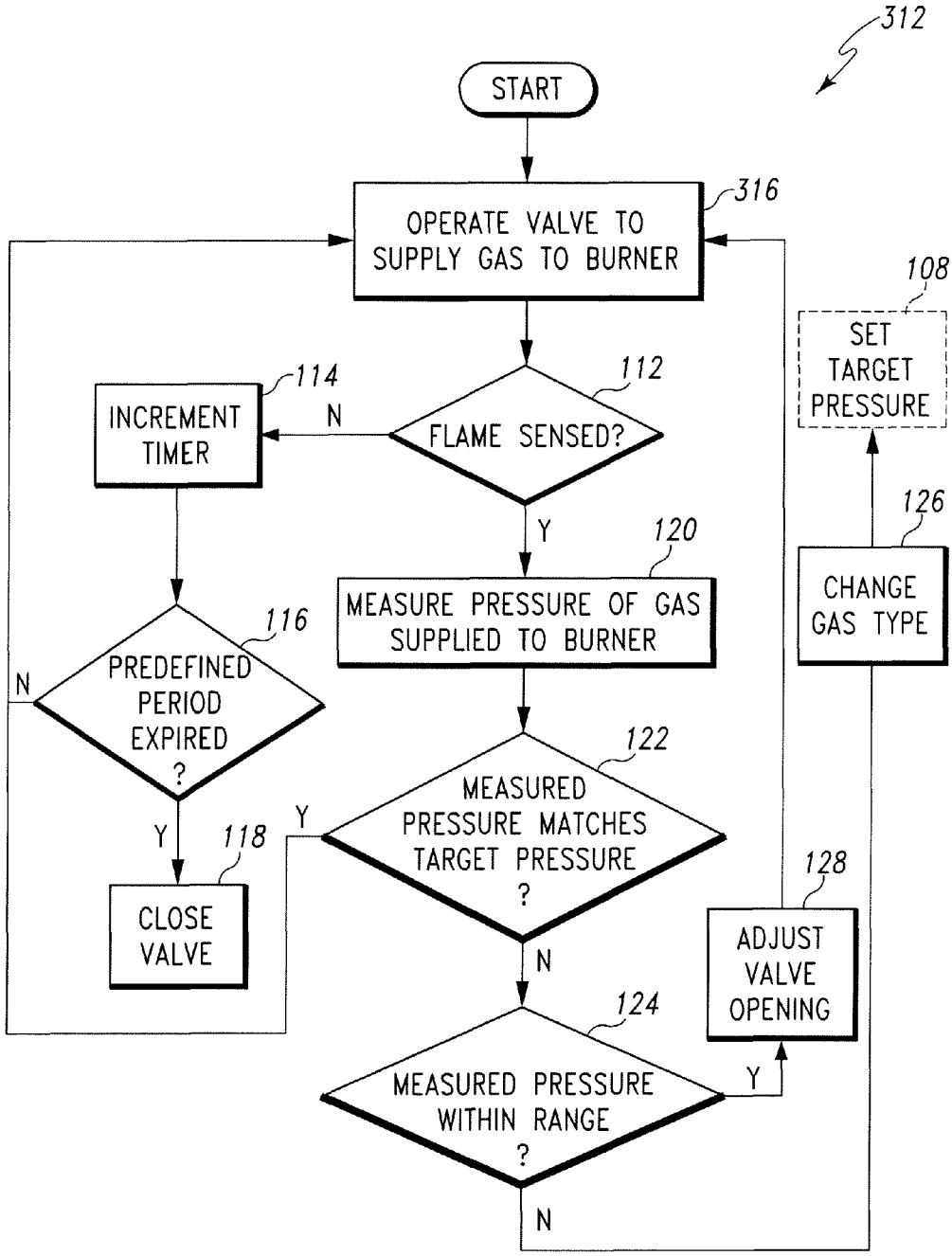
FIG. 7 is a simplified flow diagram of the continuous operation mode of the routine of FIG. 6.
Figure 8A:
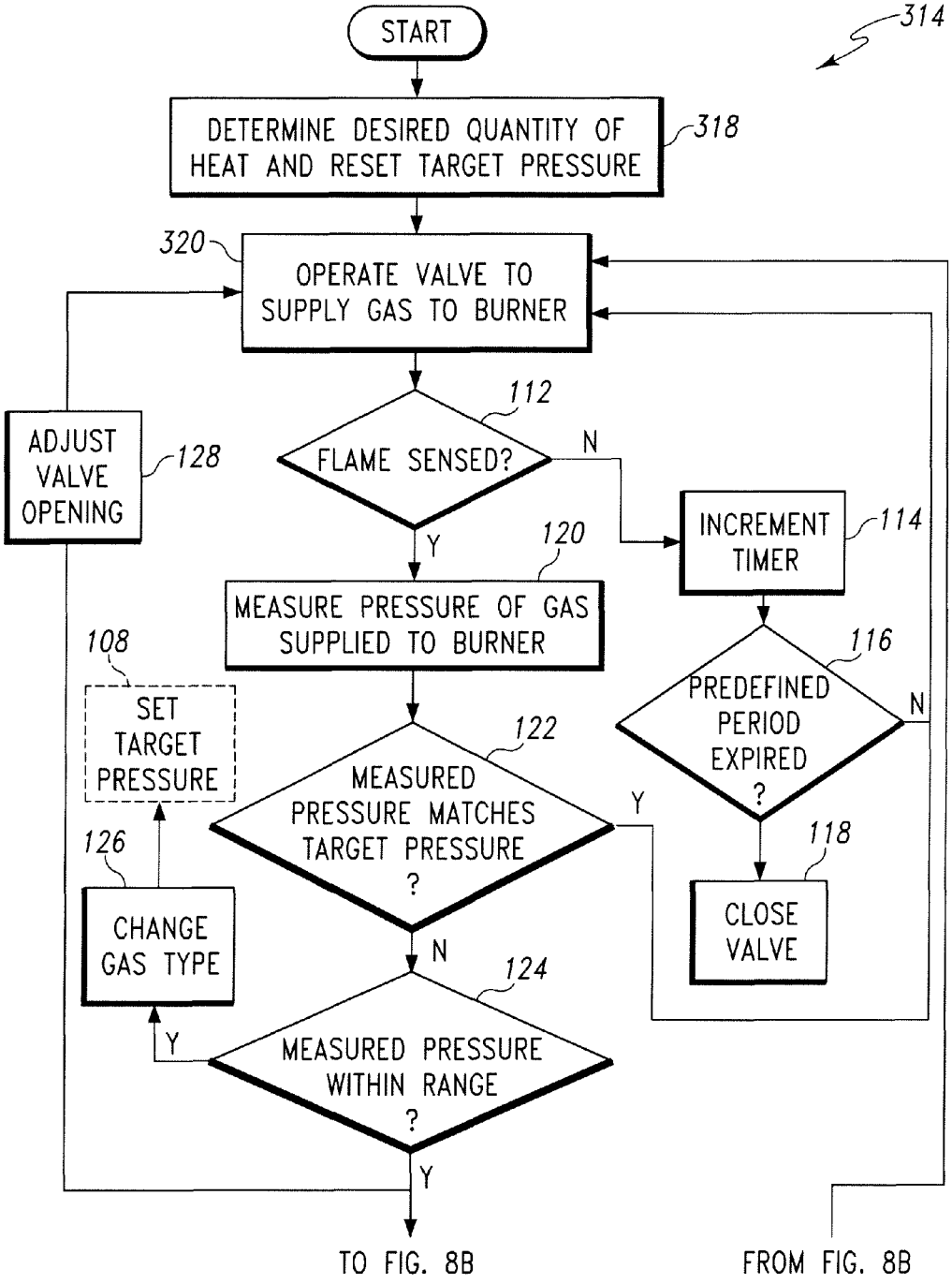
FIG. 8 is a simplified flow diagram of the duty cycle operation mode of the routine of FIG. 6.
Figure 8B:
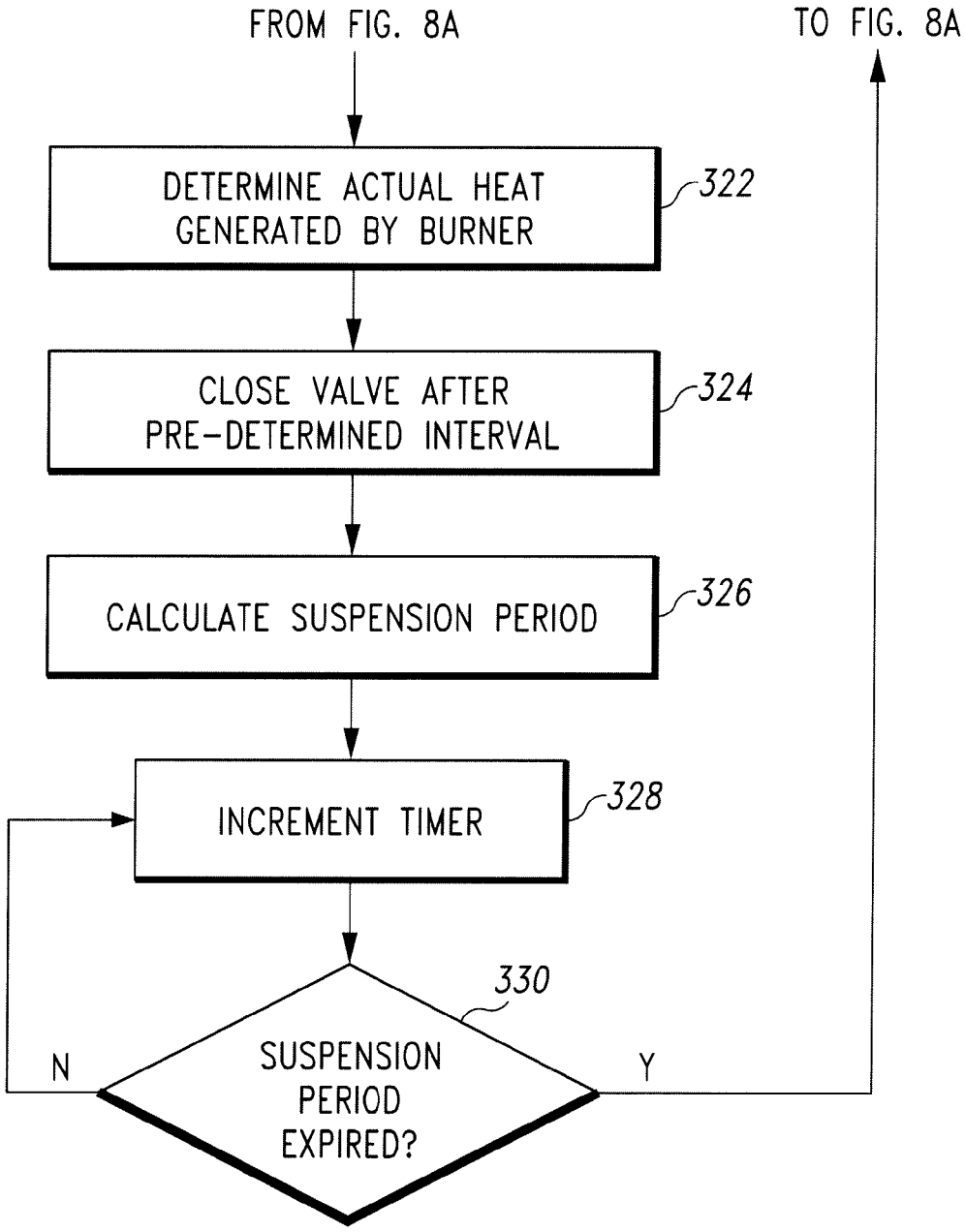

Referring to FIGS. 6-8, another illustrative control routine (i.e., routine 300) for operating the control system 50 is illustrated. Some steps of the routine 300 are substantially similar to those discussed above in reference to the embodiment of FIGS. 4 and 5. Such steps are designated in FIGS. 6-8 with the same reference numbers as those used in FIGS. 4 and 5. For example, the routine 300 commences with step 102 and includes steps 104-108, which were described above in regard to FIGS. 4 and 5. After the target pressure is determined based on the position of the control switch 36 and the burner rating of the burner 28, the routine 300 advances to step 310.

In step 310, the target pressure is compared to a minimum continuous operating pressure of the burner 28 such that an operating mode may be selected. The minimum continuous operating pressure is determined as a function of the burner rating and is typically the pressure at which the burner 28 can produce a stable flame. It will be appreciated that the minimum continuous operating pressure is a value that may be adjusted such that the desired burner performance is achieved. In other words, the minimum continuous operating pressure may include predetermined tolerance range that is higher than the exact pressure at which the burner 28 can produce a stable flame. The comparison of the minimum continuous operating pressure to the target pressure determines the operation mode for the electronic controller 76. As shown in FIG. 6, if the target pressure is greater than the minimum continuous operating pressure for the burner 28, the electronic controller 76 selects a continuous operation mode 312 from a number of operation modes stored in the memory device 96. When the target pressure is less than the minimum continuous operating pressure, the electronic controller 76 selects a duty cycle operation mode 314.

As shown in FIG. 7, the continuous operation mode 312 includes step 316. In step 316, the electronic controller 76 generates a control signal for the gas valve 66 to supply gas to the burner 28. Unless the gas valve 66 is closed because the gas burner 28 fails to ignite, the gas valve 66 is maintained in one of the open valve positions. The continuous operation mode 312 also includes steps 112-128, which were described above in reference to FIG. 5. In particular, the electronic controller 76 operates the gas valve 66 such that the measured pressure matches the target pressure.

Returning to step 310, if the target pressure is less than the minimum continuous operating pressure, the electronic controller 76 selects the duty cycle operation mode 314. In the duty cycle operation mode, the electronic controller 76 calculates the user-desired quantity of heat and uses the user-desired quantity of heat, in addition to using the measured pressure, to regulate the supply of gas to the burner 28. As described below, the gas valve 66 is cycled between open and closed positions such that the burner 28 generates an average quantity of heat that matches the desired quantity of heat.

As shown in FIG. 8, the illustrative duty cycle mode 314 commences with step 318. In step 318, the electronic controller 76 determines the desired quantity of heat associated with the target pressure. The electronic controller 76 selects a look-up table associated with the burner rating of the burner 28 from a plurality of look-up tables stored in the memory device 96. The quantity of heat produced at each of a plurality of pressure values is stored in each of the look-up tables. Using the particular look-up table associated with the burner rating of the burner 28, the electronic controller 76 selects the quantity of heat corresponding to the target pressure and sets that quantity as the desired quantity of heat. The electronic controller 76 then sets the minimum continuous operating pressure as the target pressure. After setting the target pressure and determining the desired quantity of heat, the mode 314 advances to step 320.

In step 320, the electronic controller 76 generates a control signal for the gas valve 66 to supply gas to the burner 28. The duty cycle operation mode 314 then proceeds through steps 112-128, which were described above in reference to FIG. 4. After determining that the measured pressure is within range, the mode 314 advances to step 322.

In step 322, the electronic controller 76 determines the actual heat generated by the burner 28 based on the measured pressure of the gas. Using the particular look-up table associated with the burner rating of the burner 28, the electronic controller 76 selects the quantity of heat associated with the measured pressure, which is then stored in memory device 96. The electronic controller 76 continues to take pressure measurements, determine the actual quantity of heat produced, and store the quantity of heat in the memory device 96 while gas is supplied to the burner 28. At the end of a predefined time interval, the mode 314 advances to step 324.

In step 324, the electronic controller 76 generates a control signal for the piezoelectric drive 74 close the gas valve 66, thereby suspending the supply of gas to the burner 28. After the gas supply is suspended, the mode 314 advances to step 326.

In step 326, the electronic controller 76 calculates the duration for which the supply of gas is to be suspended. Using the actual quantity of heat data stored in step 320, the electronic controller 76 calculates the average quantity of heat generated by the burner 28 over the predefined time interval. The average quantity of heat will be higher than the user-desired quantity of heat because the pressure of the gas supplied to the burner 28 was higher than the initial target pressure. To reduce the average, the electronic controller 76 adjusts the length of time over which the supply of gas is to be suspended such that the average quantity of heat generated by the burner 28 is adjusted to match the desired quantity of heat. The difference between the average quantity of heat and the desired quantity of heat therefore determines the duration of the suspension period. When the difference is greater, the suspension period is longer so that the average quantity of heat matches the desired quantity of heat. When the difference is less, only a short suspension period is required to match the two quantities.

Once the suspension period is determined, the mode 314 advances to step 328. In step 328, a timer is incremented to track the duration of the suspension period, and, in step 330, the electronic controller 76 generates a control signal for the gas valve 66 to resume supplying gas to the burner 28 at the end of the suspension period. The mode 314 then returns to step 320 to operate the gas valve 66.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A cooking appliance, comprising:

a cooking surface, a gas burner positioned below the cooking surface, the gas burner being operable to generate a quantity of heat at the cooking surface, and a gas valve comprising: (i) an outlet fluidly coupled to the gas burner, and (ii) a pressure sensor operable to measure the pressure of the gas supplied to the gas burner from the gas control valve and generate an electrical output signal indicative the measured pressure of the gas, wherein the gas valve is programmed to adjust a supply of gas to the gas burner based on the measured pressure, a target pressure and the burner rating, wherein the supply of gas is suspended after a predefined time interval to determine an average quantity of heat that is delivered to the cooking surface during the predefined time interval to calculate the suspended time interval, such that a user-desired quantity of heat is generated at the cooking surface.

2. The cooking appliance of claim 1, wherein the gas valve comprises:

an electronically-controlled piezoelectric drive operable to control the supply of gas to the gas burner, and an electronic controller electrically coupled to the pressure sensor and the piezoelectric drive, the controller comprising (i) a processor, and (ii) a memory device electrically coupled to the processor, the memory device having stored therein a plurality of instructions which, when executed by the processor, cause the processor to:

(a) communicate with the pressure sensor to determine the measured pressure of the gas supplied to the gas burner, (b) compare the measured pressure with the target pressure, and (c) operate the piezoelectric drive to adjust the supply of gas to the gas burner based on the difference between the measured pressure and the target pressure.

3. The cooking appliance of claim 2, further comprising:

a flame sensor electrically coupled to the electronic controller, the flame sensor being operable to detect presence of a flame in the gas burner and generate an electrical output signal indicative thereof, wherein the plurality of instructions when executed by the processor further cause the processor to:

(a) communicate with the flame sensor to determine if the flame has been detected within the predefined time interval, and (b) operate the gas valve to shut off the supply of gas to the gas burner when no flame has been detected within the predefined time interval.

4. The cooking appliance of claim 2, further comprising a control switch electrically coupled to the electronic controller, the control switch being operable to generate an electrical output signal indicative of the user-desired quantity of heat.

5. A cooking appliance, comprising:

a cooktop having a cooking surface, a gas burner positioned below the cooking surface, the gas burner being configured to generate a quantity of heat at the cooking surface, an electronically-controlled gas valve fluidly coupled to the gas burner to control a supply of gas thereto, a pressure sensor operable to measure the pressure of the gas supplied to the gas burner from the gas valve and generate an electrical output signal indicative thereof, and an electronic controller electrically coupled to both the gas burner and the pressure sensor, the controller comprising (i) a processor, and (ii) a memory device electrically coupled to the processor, the memory device having stored therein a plurality of instructions which, when executed by the processor, cause the processor to:

(a) communicate with the pressure sensor to determine the measured pressure of the gas supplied to the gas burner, (b) compare the measured pressure with a target pressure and a predetermined burner rating, and (c) operate the gas valve to adjust the supply of gas to the gas burner based on the difference between the measured pressure of the gas supplied to the gas burner, the target pressure and the burner rating, wherein the supply of gas is suspended after a predefined time interval to determine an average quantity of heat that is delivered to the cooking surface during the predefined time interval to calculate the suspended time interval.

6. The cooking appliance of claim 5, further comprising:

an oven positioned below the cooktop, the oven having a cooking chamber, and an oven gas burner operable to heat the cooking chamber, wherein the gas valve is fluidly coupled to the oven gas burner.

7. The cooking appliance of claim 5, further comprising:

a flame sensor electrically coupled to the electronic controller, the flame sensor being operable to detect presence of a flame in the gas burner and generate an electrical output signal indicative thereof, wherein the plurality of instructions when executed by the processor further cause the processor to:

(a) communicate with the flame sensor to determine if the flame has been detected within the predefined time interval, and (b) operate the gas valve to shut off the supply of gas to the gas burner when no flame has been detected within the predefined time interval.

8. The cooking appliance of claim 5, wherein the gas valve is operable to supply gas to the gas burner at a periodic rate.

9. The cooking appliance of claim 8, further comprising a control switch electrically coupled to the electronic controller, the control switch being operable to generate an electrical output signal indicative of a user-desired quantity of heat, wherein the plurality of instructions, when executed by the processor, further cause the processor to:

(a) receive the electrical output signal and select the target pressure and a predefined periodic rate of gas delivery that corresponds to the user-desired quantity of heat, and (b) operate the gas valve to supply gas at the target pressure in accordance with the predefined periodic rate.

10. The cooking appliance of claim 5, further comprising:

a control switch electrically coupled to the electronic controller, the control switch being operable to generate an electrical output signal indicative of the control switch position, wherein the plurality of instructions, when executed by the processor, further cause the processor to receive the electrical output signal and select the target pressure that corresponds to the control switch position.

11. The cooking appliance of claim 10, wherein:

the memory device has stored therein a plurality of pressure values as a function of a plurality of control switch positions, and the plurality of instructions, when executed by the processor, further cause the processor to select one of the plurality of pressure values as the target pressure when the control switch is in one of the plurality of control switch positions.

12. The cooking appliance of claim 11, wherein:

the memory device has stored therein (i) the plurality of pressure values and the plurality of control switch positions as a look-up table associated with the burner rating of the gas burner, and (ii) a plurality of look-up tables associated with a plurality of burner ratings, and the plurality of instructions, when executed by the processor, further cause the processor to select the burner rating and the look-up table associated therewith when the control switch is in one of the plurality of control switch positions.

* * * * *